United States Patent [19]

Adrian et al.

[11] Patent Number: 4,619,355

[45] Date of Patent: Oct. 28, 1986

[54] ESCALATOR HANDRAIL ENTRY SAFETY SWITCH ACTUATOR

[75] Inventors: Willy Adrian, Obernkirchen; Ralf Holzhauer, Stadthagen, both of Fed. Rep. of Germany

[73] Assignee: Otis Elevator Company, Farmington, Conn.

[21] Appl. No.: 763,097

[22] Filed: Aug. 6, 1985

[51] Int. Cl.[4] ..... B66B 29/00

[52] U.S. Cl. ..... 198/323; 198/338; 200/52 R

[58] Field of Search ..... 200/52 R, 61.41, 61.42, 200/61.58 R, 303, 298; 198/322, 323, 337, 338

[56] References Cited

U.S. PATENT DOCUMENTS

| | | | |
|---|---|---|---|
| 2,846,045 | 8/1958 | Fowler | 198/323 |
| 3,809,206 | 5/1974 | Bredehorn et al. | 198/323 |

*Primary Examiner*—A. D. Pellinen
*Assistant Examiner*—Morris Ginsburg
*Attorney, Agent, or Firm*—Gerald E. Linden

[57] ABSTRACT

Two generally U-shaped pieces are adapted to fit together end-to-end so that when they are nested in an appropriately-sized passage in an escalator entry box, they cooperate to form a generally cylindrical actuator that at one end has brushes protruding through the opening of the entry box and that is slideable in the entry box over the handrail to actuate a safety shutoff switch located therein in the unlikely event of a foreign object being pulled by the handrail into the entry box.

2 Claims, 2 Drawing Figures

ESCALATOR HANDRAIL ENTRY SAFETY SWITCH ACTUATOR

DESCRIPTION

1. Technical Field of the Invention

The invention relates to escalator safety in the area of the handrail entry box.

2. Background of the Invention

While escalators are basically safe, and passengers have become familiar with elementary safety precautions, certain safeguards are still considered prudent to protect against accidents. For example, it is known to provide a safety switch that will shut off the drive motor in the event that something is pulled by the handrail into the handrail entry box. It is important that the mechanism for actuating the switch operate smoothly, so that it works when called upon up to do so and so that it does not snag on the handrail, which would cause a false shutdown condition. It is also desirable that the actuator for the switch be simple to manufacture and easy to install and service.

DISCLOSURE OF THE INVENTION

Therefore, it is an object of this invention to provide an improved handrail entry safety switch actuator.

According to the invention, two generally U-shaped pieces are adapted to fit together end-to-end so that when they are nested in an appropriately-sized passage in an escalator entry box, they cooperate to form a generally cylindrical actuator that at one end has brushes protruding through the opening of the entry box and that is slideable in the entry box over the handrail to actuate a safety shutoff switch located therein in the unlikely event that a foreign object is pulled by the handrail into the entry box.

The end-to-end fit of the halves forms a mortise and tenon joint to hold the halves in register longitudinally. One end of each U-shaped half is the mortise, and the other end is the tenon so that the halves are identical.

Other objects, features, and advantages of the invention will become more apparent in light of the following description thereof.

BEST MODE FOR CARRYING OUT THE INVENTION

Figure 1:
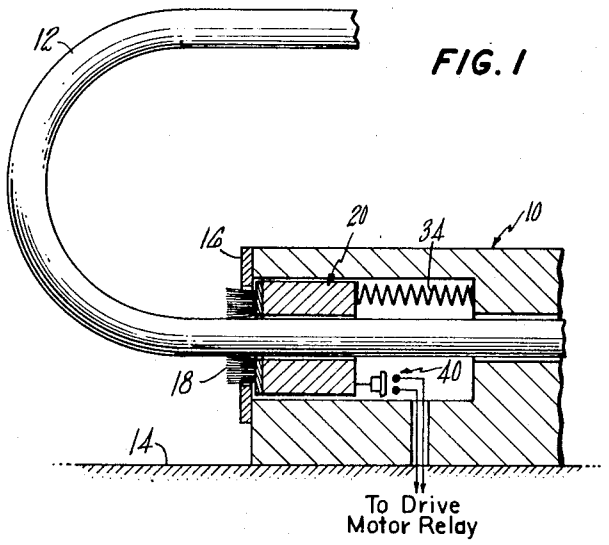
FIG. 1 is a mixed side cross-sectional view and schematic of the entry box for the returning handrail of an escalator, exaggerated to show the situation of the actuator of this invention.

FIG. 1 shows a handrail entry box 10 for receiving a handrail 12 that is traveling in the direction indicated by the arrow. Although it is extremely unlikely, due to the proximity of the box to the floor 14, someone could inadvertently grasp the handrail where it enters the box. The consequent pulling action of the handrail, if left unchecked, could pull one's hand into the entry box.

Figure 2:
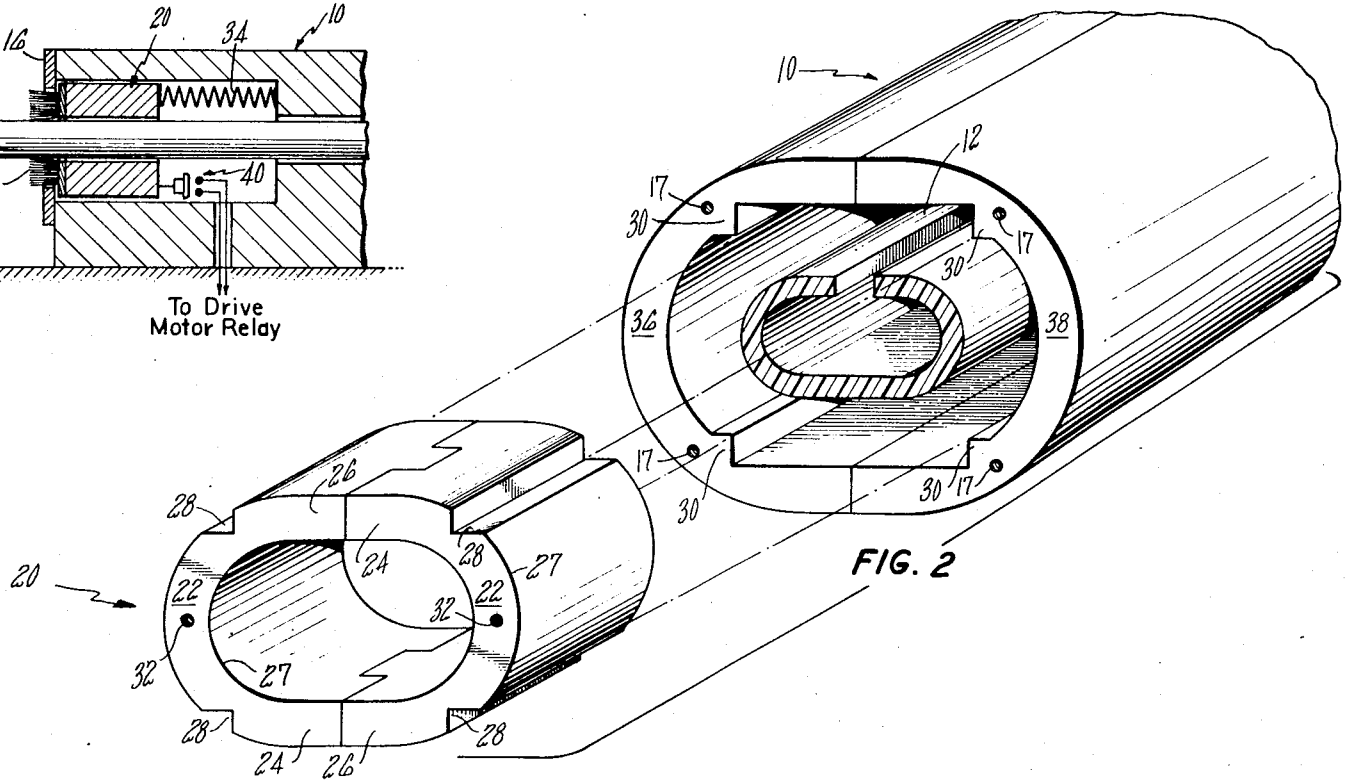
FIG. 2 is an exploded perspective detail view highlighting the actuator of this invention.

The handrail 12 enters the box 10 through an opening, such as a hole in a faceplate 16 on the box. The faceplate 16 covers the front of the box 10 and is attached thereto by bolts (not shown) and suitable threaded holes 17 (as shown in FIG. 2) in the box 10. The faceplate opening is naturally larger than the handrail. Therefore, brushes 18 are provided to seal the faceplate opening.

A generally cylindrical actuator piece 20 encompasses the handrail 12, and is better viewed in FIG. 2. The actuator 20 has two identical U-shaped halves 22. Each half 22 has two generally straight legs 24, 26, and a bight, or curved, portion 27 connecting the legs. Midway along the base of each leg 24 there is a rectangular notch, or mortise, and midway along the base of each leg 26 there is a corresponding rectangular projection, or tenon. Thus, when the halves 22 are brought together, end-to-end, they interlock to form a mortise and tenon joint. This keeps the halves 22 in register, longitudinally, when the actuator 20 is called upon to slide along the handrail.

The halves 22 are not fastened together. Rather, they are held together by the box 10, which also guides the actuator 20, as it slides longitudinally, in the following manner. Each U-shaped piece 22 has two longitudinal rectangular notches 28, each notch disposed roughly at the bight end of one of the legs 24, 26. Corresponding longitudinal rectangular projections 30 are provided in the box 10, and are sized so as to slidingly engage the notches 28 when the actuator is nested in the box. It is evident from a close examination of FIG. 2 that there is adequate clearance between the outside of the actuator and the box, and between the inside of the actuator and the handrail 12 so that the actuator can slide freely with respect to both. The brushes 18 are attached to the front of the actuator, such as by bolts inserted into threaded holes 32 in each half 22, so that the brushes move with the actuator, rather than being fixed to the faceplate. By providing threaded holes on the back side (not visible) of the actuator, installation becomes virtually "idiot-proof". One of the nice things about the actuator 20 of this invention is not only that the halves 22 are identical, but that they cannot be installed the wrong way.

Returning to FIG. 1, it is seen that the actuator 20 is urged against the faceplate 16, which functions as a stop for the actuator, by a spring 34, which is shown schematically, and which is disposed in a suitable manner in the box. Therefore, when a foreign object begins to enter the faceplate opening, it pushes against the brushes 18 which are stiff enough to transmit the object's force to the actuator and overcome the spring force so that the actuator moves in response thereto. A switch 40 is positioned in a suitable manner in the box 10 so that movement of the actuator away from the faceplate 16 will operate the switch 40 and cause a drive motor relay (not shown) to trip OFF, thereby stopping the escalator.

Returning to FIG. 2, it will be noted that the box 10 can be clamshell halves 36, 38, similar to the halves 22 of the actuator to provide for corresponding ease of installation and maintenance.

What is claimed is:

1. An actuator for the handrail entry safety switch in the entry box of an escalator comprising:

two generally U-shaped pieces disposed end-to-end with the bases of the legs of one piece juxtaposed with the bases of the legs of the other piece so as to form a generally cylindrical actuator, the inside of which is sized so as to permit the handrail to pass therethrough and the outside of which is sized and shaped so as to nest within, and be guided longitudinally by the entry box.

2. The actuator of claim 1 wherein midway along the base of one leg of each piece is a rectangular notch; and midway along the base of the other leg of each piece is a corresponding rectangular projection, sized to cooperate with the rectangular notch of the other piece.

* * * * *